United States Patent [19]

Bogle

[11] 4,161,044

[45] Jul. 17, 1979

[54] COVER SECURE CONTOUR BED SHEETS

[76] Inventor: Gladys D. Bogle, 1650 Loganrita Ave., Arcadia, Calif. 91006

[21] Appl. No.: 893,767

[22] Filed: Apr. 5, 1978

[51] Int. Cl.[2] ..... A47G 9/00

[52] U.S. Cl. ..... 5/494; 5/497

[58] Field of Search ..... 5/334, 334 C, 335, 336

[56] References Cited

U.S. PATENT DOCUMENTS

| | | | |
|---|---|---|---|
| 2,677,137 | 5/1954 | Bergin | 5/334 C |
| 2,799,870 | 7/1957 | Sullivan | 5/335 X |
| 3,083,378 | 4/1963 | Pursell | 5/334 C |

*Primary Examiner*—Casmir A. Nunberg
*Attorney, Agent, or Firm*—William H. Maxwell

[57] ABSTRACT

Combined bottom and top contour bed sheets for ensuring covered confinement of a sleeping person, especially infants, the bottom sheet being form fitted to the mattress and the top sheet releasably secured by a slide fastener to the bottom sheet and fitted to the bed coverings by a flap which confines said coverings and prevents displacement thereof.

8 Claims, 6 Drawing Figures

COVER SECURE CONTOUR BED SHEETS

BACKGROUND

Bedding is comprised generally of a mattress supported upon springs by a bedsted and over which a padding and/or sheets are applied for cleanliness and between which a person lies. The sheets protect the underlying pads and mattress, and protect the overlying covers as well. Heretofore, the sheeting has been divided between top and bottom sheets fitted separately to the mattress and over which the covers are independently fitted. It has been common practice to form-fit bed sheets individually so that they remain intact; a practice widely accepted with respect to the bottom sheet, but not so widely accepted with respect to the top sheet. Consequently, the top sheets, even when fitted at the foot of the bed, tend to slide off the bed with the blankets, thereby exposing the person since no means is provided for ensuring retension of the top bedding in proper position.

Infants and younger children are of particular concern herein, for example those who are bedded down in cribs and the like. Such small persons often uncover themselves by rolling and kicking off the top bedding which is normally unsecured, though straps have been employed for such securement in cribs, and especially in hospitals and in the transport of invalids etc. However, it is the child under ordinary domestic care with which we are here concerned, a child who has not yet reached the age where he can be cognizant of his bedding condition during sleep; it being understood that an adult sleeping person periodically awakens sufficiently to maintain a proper arrangement of the bed covers. With a child, however, such an awareness can be entirely absent and it is necessary for the parents to constantly check upon and rearrange the bedding. Therefore, it is an object of this invention to provide means by which the top bedding is secure, such that the rolling and kicking or flailing of the child cannot displace said bedding.

It is a general object of this invention to provide contour sheets for embracing the person, especially a child, so that the covers cannot be displaced. More specifically, it is an object herein to provide an accessible enclosure of bed sheets wherein the top and bottom sheets are joined in a combination adapted to be opened for both access and airing or washing. With this invention, the top and bottom sheets are joined, the bottom sheet being form-fitted to the mattress and the top sheet form-fitted to the blankets or covers. As a result, the bottom sheet cannot be displaced from the mattress and the top sheet and blankets cannot be displaced from the bottom sheet. That is, the person embraced within the two sheets when they are closed together cannot disturb them in a manner to dislodge them or the covers retained thereby.

SUMMARY OF INVENTION

This invention relates to contour sheets for the bedding down of children or other persons who have difficulty in maintaining cover during sleep. Characteristically, it is combined top and bottom sheeting which are related herein for easy access and secure enclosure of a person. It is a unit of construction which involves bottom and top sheets A and B joined along one or more sides thereof by a slide fastener X or the like. In practice, one side of the combination is joined permanently while the other side and foot are releasably joined by said fastener. The bottom sheet A fastens the contouring panels that depend therefore to embrace the mattress, and the top sheet B features a flap C to capture the blankets or covers. By releasing the top sheet B from the bottom sheet A throughout the length of the fastener X, complete opening is attained for washing or cleaning or airing. Or, by partial release of the fastener X along one side, opening for access is established whereby a person can get into and out of the sheet enclosure with facility. As indicated, the blankets or covers are carried with the top sheet B by tucking the same beneath the flap C, all as herein described.

DRAWINGS

The various objects and features of this invention will be fully understood from the following detailed description of the typical preferred form and application thereof, throughout which description reference is made to the accompanying drawings, in which.

PREFERRED EMBODIMENT

Figure 1:
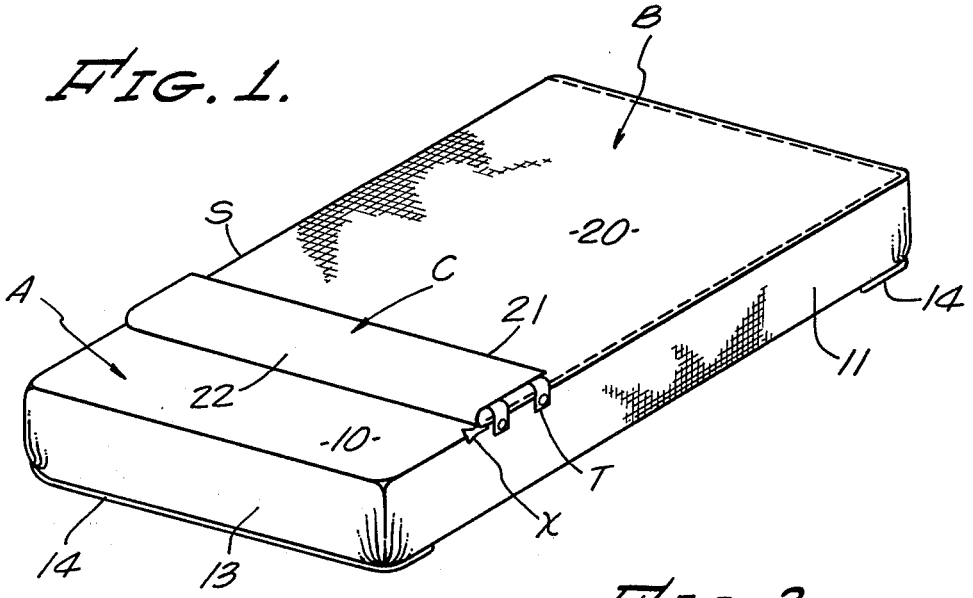
FIG. 1 is a top perspective view taken from the head and one side of the bed sheet combination.

Referring now to the drawings, there is a combination of top and bottom form-fitted bed sheets, a bottom sheet A for embracing a mattress (not shown), and a top sheet B for embracing a person and to receive and thereby secure the head portions of the blankets or covers (not shown). In its preferred form, this sheet combination is sewn together at S so that sheets A and B are inseparable, thereby to be used, washed or cleaned and/or aired as a unit. Accordingly, the top sheet B is sewn to the bottom sheet A along one side, or along the foot, preferably coextensively along one side, the remaining joinder being by means of a slide fastener X or the like. In accordance with bed making practice, the top sheet B extends from the foot of the bottom sheet A to substantially overlie said bottom sheet and stopping short of the head thereof where it is folded back in the form of the flap C to capture the blanketing.

The bottom sheet A is comprised of a rectangular panel 10 that coextensively overlies the mattress, and continuous panels depending therefrom that coextensively embrace the sides, foot and head of the mattress. In practice, there are side panels 11, a foot panel 12 and a head panel 13 all of a height to more than cover the complimentary sides, foot and head of the mattress. The said panel 11–13 continue from or are sewn to the panel 10 so as to depend normal therefrom, there being elastic members 14 to draw the lowermost margins of the panels together thereby to secure the bottom sheet to said mattress.

The top sheet B is comprised of a rectangular panel 20 that coextensively overlies a substantial portion of the above described bottom sheet A, and the flap C free to be turned back so as to expose the head portion of the panel 10 of bottom sheet A. The top sheet B has no depending panels which are common to ordinary top sheets, and in lieu thereof is affixed to the bottom sheet A along the seam S which joins the top panel 10 to the side panels 11 and foot panel 12. In carrying out this invention, the panel 20 is permanently affixed along at least one edge of the panel 10 and preferably along one side panel 11 thereof, as shown. However, it is to be understood that the panel 20 can be permanently affixed along the foot panel 12, in which case there can be separate slide fasteners X to releasably affix the panel 20 along both side panels 11. In the preferred form, the panel 12 is permanently affixed along one side as shown, with the single slide fastener X extending along the foot and other side for opening access. The joinder of the sheet B to the sheet A is along the corner or edge seams that join the depending contour panels to the overlying panel 10.

Figure 5:
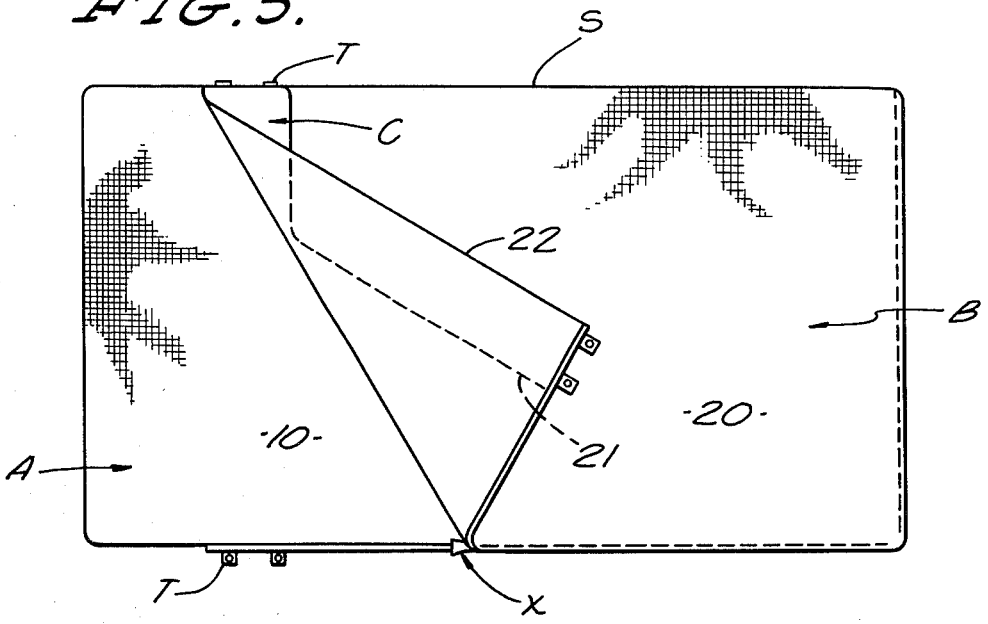
FIG. 5 is a closed plan view of the combined bed sheets with the top sheet turned back for entry of a person.
Figure 6:
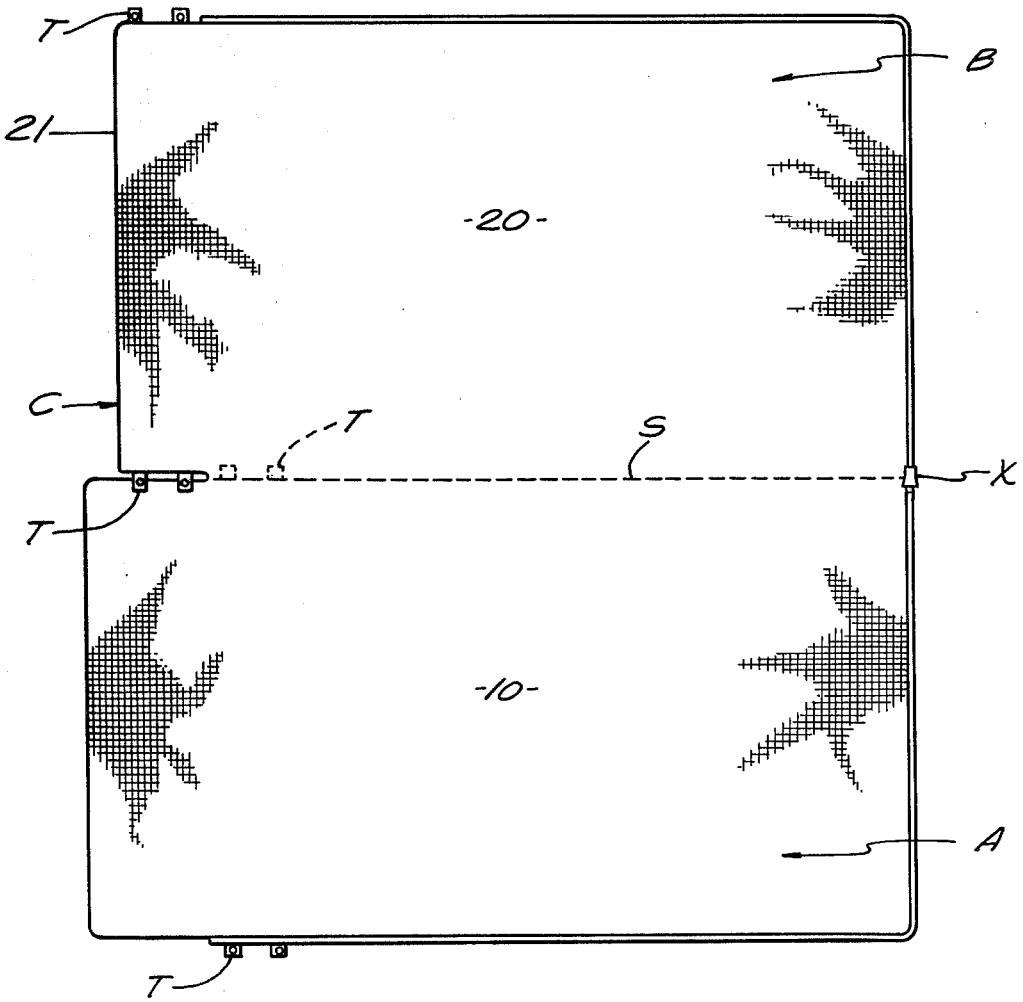
FIG. 6 is an opened plan view illustrating the combined bed sheets conditioned for airing and/or washing.

The flap C is a continuation of the panel 20 of sheet B and extends therefrom along a transverse fold 22 (see FIG. 1). The said flap C is to be thrown back along the side where it has been released (see FIG. 5), or the entire top sheet B is to be thrown open along the permanently affixed side or seam S (see FIG. 6). Accordingly, the flap C represents a substantial margin of and at the head of sheet B, sufficient to overlie and capture blankets that are tucked thereunder; for example a nine inch turn-down being adequate in an infant's crib sheet combination.

Figure 3:
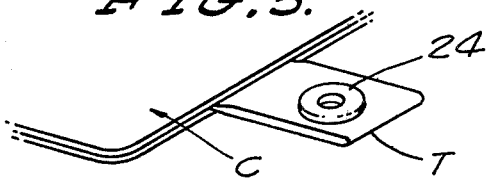
FIG. 3 is an enlarged fragmentary view of the straps that extend from the flap C.
Figure 2:
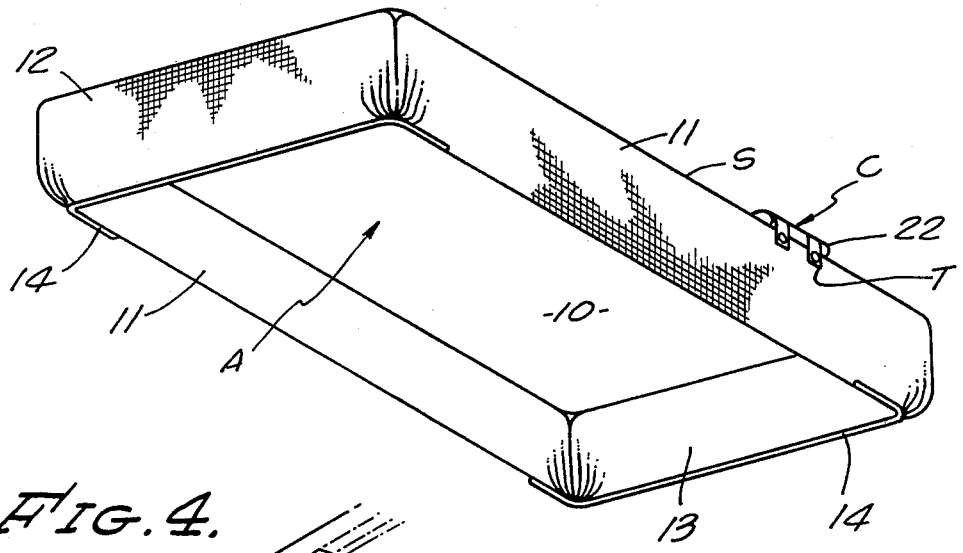
FIG. 2 is a bottom perspective view taken from the foot and the other side of the bed sheet combination.
Figure 4:
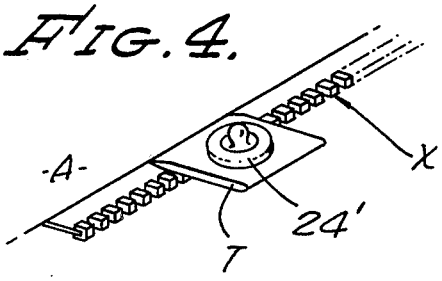
FIG. 4 is a fragmentary view of the attachment for said straps on the lower bed sheet.

In accordance with this invention there is the slide fastener X and straps T for the secure hold-down of the top sheet B and flap C respectively. The slide fastener X is a continuous "zipper" or the like which comprises tapes sewn into the complimentary edges to be releasably affixed; illustrated as completely affixed in FIG. 1, partially affixed in FIG. 5, and completely released in FIG. 6. Referring to FIG. 2, the straps T are illustrated as they are secured by snap fasteners 24, there being spaced straps T at the fold 22 and at the flap edge 21. Each strap T is comprised of mated snap fasteners 24–24' (see FIGS. 3 and 4) installed in flexible strapping that projects from the flap C and from between the panels 10–11 respectively, strapping that is sewn into the seams of said panels or said fasteners X as the case may be.

From the foregoing it will be seen that a very simple and practical bedding is provided for ensuring cover over the infant or such other person requiring this securement during sleep. The bottom sheet A is stretched over the mattress, the elastic members 14 along the lower margins of the panels 11–13 constricting to hold the bottom sheet in position. The slide fastener X is operated to close the sheet B with sheet A and the blankets or covers arranged thereover as may be required, whereupon the flap C is turned back and secured by the straps T. As a result, the infant person is safely bedded down and unable to destroy the integrity of the bed covers which enclose him. Consequently, the infant remains covered and the chance of entanglement within the sheets and covers is virtually eliminated.

Having described only the typical preferred form and application of my invention, I do not wish to be limited or restricted to the specific details herein set forth, but wish to reserve to myself any modifications or variations that may appear to those skilled in the art as set forth within the limits of the following claims:

I claim:

1. Bedding for ensuring the covered confinement of a sleeping person, and including in combination; a contoured bottom sheet comprised of a panel to coextensively overlie a mattress and having depending panels form-fitted to embrace said mattress, and a top sheet to substantially overlie the bottom sheet and permanently secured to the bottom sheet along one side thereof and releasably secured to the foot and other side thereof and having a flap turned back from its head portion and fitted to and retaining loose bed coverings.

2. The bedding sheet combination as set forth in claim 1, wherein the releasable side and foot of the top sheet are secured to the bottom sheet by a continuous slide fastener.

3. The bedding sheet combination as set forth in claim 1, wherein the flap of the top sheet is transversely free of the securement between the sides of said bottom sheet.

4. The bedding sheet combination as set forth in claim 1, wherein the flap of the top sheet is held to the sides only of the bottom sheet by fastener means releasably engaged therebetween.

5. The bedding sheet combination as set forth in claim 1, wherein the flap of the top sheet is releasably held to the sides only of the bottom sheet by snap fasteners engaged therebetween.

6. The bedding sheet combination as set forth in claim 1, wherein the releasable side and foot of the top sheet are secured to the bottom sheet by a continuous slide fastener, and wherein the flap of the top sheet is releasably held to the sides only of the bottom sheet by snap fasteners engaged therebetween.

7. The bedding sheet combination as set forth in claim 1, wherein the flap of the top sheet is transversely free of the securement between said bottom and top sheets and is held to the sides only of the bottom sheet by fastener means releasably engaged therebetween.

8. The bedding sheet combination as set forth in claim 1, wherein the releasable side and foot of the top sheet are secured to the bottom sheet by a slide fastener, and wherein the flap of the top sheet is transversely free of securement between said bottom and top sheets and held to the sides only of the bottom sheet by separate fastener means releasably engaged therebetween.

* * * * *